United States Patent [19]

Sun

[11] 4,330,261

[45] May 18, 1982

[54] HEATER DAMPER CONTROLLER

[75] Inventor: James H. Sun, Homewood, Ill.

[73] Assignee: Atlantic Richfield Company, Philadelphia, Pa.

[21] Appl. No.: 75,924

[22] Filed: Sep. 17, 1979

[51] Int. Cl.[3] ..... F23N 3/00

[52] U.S. Cl. ..... 431/14; 431/20; 431/76; 236/15 E

[58] Field of Search ..... 431/14, 20, 75, 76, 431/89; 236/15 E; 251/131, 134, 133

[56] References Cited

U.S. PATENT DOCUMENTS

| | | | |
|---|---|---|---|
| 3,074,644 | 1/1963 | Geniesse | 431/76 |
| 3,602,487 | 8/1971 | Johnson | 431/76 |
| 3,947,217 | 3/1976 | Graat et al. | 431/76 |
| 3,954,383 | 5/1976 | Bryant | 251/131 |
| 4,045,292 | 8/1977 | Matsushita et al. | 236/15 E |
| 4,097,218 | 6/1978 | Womack | 431/76 |
| 4,112,885 | 9/1978 | Iwata et al. | 251/131 |

FOREIGN PATENT DOCUMENTS

| | | | |
|---|---|---|---|
| 2745459 | 6/1978 | Fed. Rep. of Germany | 431/76 |

OTHER PUBLICATIONS

"Computerized Control System for Improved Combustion Efficiency", Gulitz et al., *IBM Technical Disclosure Bulletin*, vol. 18, No. 2, Jul. 1975, pp. 428–429.

*Primary Examiner*—Samuel Scott
*Assistant Examiner*—Lee E. Barrett
*Attorney, Agent, or Firm*—John B. Goodman

[57] ABSTRACT

A microprocessor based controller for regulating the position of a stack damper in a combustion furnace by feedback control adjusting damper position in view of an operator input target value of excess oxygen and an actual monitored excess oxygen value. A feedforward control overrides the feedback control for a time period initiated by the feedforward control responding to process variables indicating increase in combustion demand.

11 Claims, 2 Drawing Figures

HEATER DAMPER CONTROLLER

BACKGROUND OF THE INVENTION

The invention relates to apparatus for minimizing fuel consumption in a refinery furnace by maintaining stack oxygen content at a low level under operating constraints, and more particularly relates to apparatus for controlling stack oxygen content in relation to operator input of targeted excess stack oxygen.

In recent years the use of apparatus for controlling various technical processes such as chemical processes for distillation, extraction and refining of petroleum and the like, has been developed. Certain variables of the process are measured and certain inputs controlled to enable the process to be driven in a more economical manner.

With respect to combustion processes in process furnaces, and the like, apparatus has been provided for conrolling the air supplied to the furnace, close to the requirement for combustion in order to minimize heat loss to flue gas. Such apparatus have included large-scale analog or digital calculating machines which utilize values of measured variables for automatically adjusting the air supplied to the furnace.

All such large scale computer systems of this type, however, involve very expensive equipment. Thus, it would be highly welcomed if a simplified and reliable system were developed.

SUMMARY OF THE INVENTION

An object of the invention is to provide a simplified controller for controlling the stack oxygen level in a combustion efficiency.

A further object of this invention is to provide a controller which anticipates increase oxygen need required in accordance with positive process advance in order to safely control the oxygen level.

A further object of the invention is to provide a controller which relates the actual excess oxygen level with an inputted desired excess oxygen level for controlling the position of a stack damper, and monitors process variables for overriding such stack damper control for a time period in order to permit generation of anticipated oxygen level needed for combustion.

These and other objects are achieved in a stack damper controller for receiving operator input of targetted stack oxygen level and for adjusting the position of the stack damper according to the target value. Override of the targetted adjustment is generated by input of process variables demanding increase combustion need. The override occurs for a period of time during which the damper is opened in accordance with the anticipated need.

DESCRIPTION OF THE PREFERRED EMBODIMENT

Figure 1:
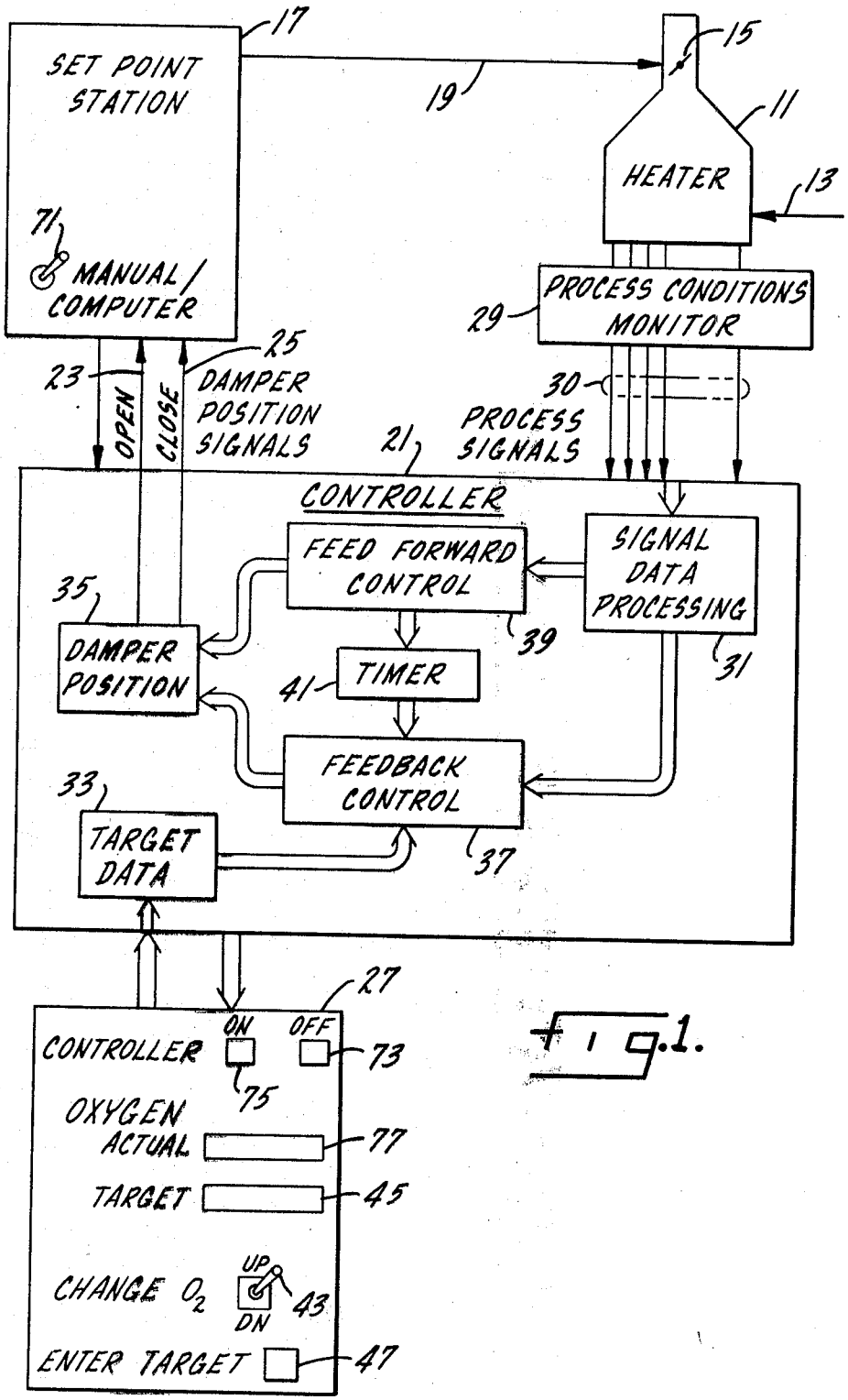
FIG. 1 is a block diagram of the controller of the preferred embodiment of the invention, shown in relation to associated apparatus.

Referring to FIG. 1, a refinery furnace or heater 11 receives fuel and control signals at input 13, for performing a refinery heating process in which combustion is performed in the heater. The oxygen level necessary to perform the combustion is controlled according to the position of a stack damper 15 which is arranged in the top of the stack of the heater and is rotatable for changing air passage through the stack. Damper 15 is rotated under control of a set point station 17 which generates an electrical control signal along a lead 19 for changing the position of the damper.

A controller 21 is responsive to the operating conditions of heater and to manual input control by the operator, for controlling operation of set point station 17 to change the position of damper 15. The position of damper 15 is automatically regulated by controller 21 for controlling the oxygen supply close to oxygen, requirement for combustion, in order to achieve a minimum fuel consumption level in the heater. Controller 21 generates a serial output pulse train to set point station 17 along either one of a pair of leads 23, 25 for respectively opening and closing damper 15.

An operator input device 27 permits the operator to transmit to controller 21 an oxygen target level indicative of a desired excess oxygen level above the oxygen combustion requirement, to be maintained in the stack. Controller 21 receives the target data and responsively controls the damper in order to establish the stack oxygen content in conformance with the target value.

Monitoring transducers, indicated by diagram block 29, are located within the heater and associated fuel and combustion control apparatus, for generating electrical analog signals indicative of the condition of individual process variables. The analog signals are transmitted to controller 21 along a plurality of leads 30. Controller 21 responds to signals developed along leads 30 and responsively controls the damper position where the analog signals indicate an increase requirement in stack oxygen due to an increase in combustion demand.

In the preferred embodiment, controller 21 is constructed from a commercially available microprocessor and associated electronic components which control the overall system processing and management of controller 21. The controller performs a number of tasks which may be summarized as follows:

(1) analog condition signals are retrieved from leads 30 and processed to form signal data which are a measure of the process variables, illustrated by control block 31;

(2) operator input data is received from input device 27 and target data indicative of a target excess level is stored in memory, illustrated by control block 33;

(3) the signal data at 31 and operator input data at 33 are manipulated in order to formulate a damper position value; illustrated by control block 35; and (4) output data is formulated in view of the damper position value at 35 for controlling set point station 17, and other output data are formulated for displaying visual output information, for initiating alarms, etc., as described hereinafter.

In general, controller 21 controls the position of damper 15 by two different modes of control: (1) a feedback control, represented by control block 37, and (2) a feedforward control, represented by control block 39. The controller utilizes feedback control 37 when positioning the damper responsive to the target data at 33. A conventional oxygen analyzer (not shown) is located in the stack and monitors the excess oxygen level with respect to combustion. When the measured excess oxygen level deviates from the target data, a damper position value at 35 is generated by the controller and serial output signals are responsively transmitted to set point station 17 to compensate for the deviation.

The setpoint station, in response to the serial output signals, changes the damper position. As the excess oxygen level in the stack then changes, a new measured excess oxygen level is compared with the target value and the damper position is appropriately readjusted. This feedback operation continues until the measured excess oxygen level corresponds to the excess oxygen target data.

The controller utilizes feedforward control 39 when positioning the damper in anticipation of an increase need for stack oxygen, responsive to detecting a demand for increased combustion. The analog signals on leads 30 will carry information of an increased demand in combustion, and controller 21 will respond accordingly, generating an anticipated damper position at 35, for appropriately adjusting the damper.

Feedforward control 39 takes priority over feedback control 37. A timer, represented by control block 41, is actuated for permitting the effects of the feedforward control to stabilize before the feedback control begins operating, permitting the feedforward control to change the damper position without interference from the feedback control. Timer 41 inhibits operation of the feedback control for a period of time preventing the two controls 37, 39 from opposing one another as each responds to different controlling signals.

Thus, feedback control 37 maintains the stack oxygen content at a level dictated by the operator. Should a demand for increased combustion occur, the feedforward control takes over controlling the damper position and the feedback control is inhibited for a period of time. Thus, combustion safety is insured by letting the air increase lead the increase in fuel and letting air decrease lag the decrease in fuel.

In the preferred embodiment, thirteen analog signals are received along leads 30, representing the conditions of the following process variables:

Damper Position
Excess Stack Oxygen
Fire Box Pressure
Fuel Gas Flow
Fuel Oil Flow
Fuel Gas Gravity
Fuel Gas Pressure
Stack Temperature
Fuel Gas Temperature
Heater Outlet Temperature
Heater Inlet Temperature
Set Point Position of Outlet Temperature Controller
Process Heater Feed Flow (flow of material being heated)

Each of the analog signals appearing alongs leads 30 are converted to digital data for storage in memory by controller 21, as represented by control block 31. Transducers 29 monitoring the process variables may include conventional thermocouples which provide a signal representative of temperature, conventional pressure transmitters for monitoring gas pressure and providing a signal representative thereof, conventional flow transmitters which monitor flow rate and generate signals related thereto, conventional position sensors for monitoring the positions of damper 15 and of the temperature set point on the outlet temperature controller of the heater, a conventional excess oxygen analyzer for monitoring excess oxygen level and a conventional fuel gas gravity sensor for monitoring fuel gas gravity.

Data processing control 31 processes the process signals developed along leads 30 for generating signal data in a form usable by controller 21. Initially the analog process signals developed along leads 30 are converted to a digital signal by an analog-to-digital converter (not shown). An analog-to-digital conversion method of voltage-to-frequency conversion is utilized in the preferred embodiment to convert the analog process signals for superior measuring stability.

After the analog signals are converted to digital signals, the digital signals are stored in memory in the form of digital data. Controller 21 then checks the signal value of each process variable against a limit range for determining whether the signal value falls outside the limit range. Where the signal value falls outside of its limit range, an appropriate alarm is sounded for indicating an instrument malfunction with respect to that process variable signal. In the preferred embodiment the analog signals developed along leads 30 have a current reading between 4 and 20 milliamps. Any reading outside of this range indicates an instrument malfunction.

The controller 21 also performs a calibration on the analog-to-digital converter for maintaining its operational accuracy. A standard predetermined analog signal source feeds an analog signal periodically to the analog-to-digital converter for formulating a digital signal which is checked against the value of the standard source. The converter is automatically adjusted so that the converted digital value conforms to the standard value. This is designed to avoid any drifting effect of the converter and insures the correctness of the conversion performed.

After the instrument check and analog-to-digital converter calibration are passed, the digital data is converted to an appropriate engineering unit (EU) for filtering. A linear filtering is performed for the position variables, pressure variables, fuel gas gravity variable, temperature variables and the excess stack oxygen variable. For example, the EU is calculated according to the following formula:

$$EU = AX + B,$$

where A and B are conversion factors determined for each process variable and are stored in memory. X is the digital value of the analog process signal being converted.

The fuel gas flow, however, is converted according to a following engineering unit formula:

$$EU = A\sqrt{\frac{XP}{TG}}$$

where P equals gas pressure in psia, T = gas temperature in °R, G = gravity in specific gravity units at 60° F. (air = 1.0), and A = conversion constant. X is the digital value of the process signal being converted.

For fuel oil flow, and process heater feed flows, the engineering unit formula is $$EU = A\sqrt{X}$$

where A = conversion constant. X is the digital value for the process signal being converted.

The excess oxygen analyzer presents a signal that linearly varies with the log of oxygen content. Therefore, a conversion equation is of the form:

$$EU=e^{A+BX}$$

where A and B are constants, and e=base of natural logrithm (2.718). X is the digital value for the process signal being converted.

Once the EU's for each process variable are calculated, a mathematical filtering is performed by adding a certain percentage of the prior EU value to a certain percentage of the new EU value. The following formula with an adjustable filtering factor assigned to each measurement is preferred:

$$V_i=A\cdot X+(1-A)\cdot(V_{i-1})$$

where V is the filtered value, subscript i means current and subscript i−1 means last, X is the unfiltered measurement (EU) and A is the filtering factor where $0<A\leqq 1$. The filtered values are stored in a table at 31 for use by the controller.

Besides checking the instrumentation functioning by measuring the current magnitudes of the analog signals developed along leads 30, the controller may optionally include means to check reasonability limits which are ranges of normal operating conditions of each process variable. Where this value falls out of a reasonable value range, the controller initiates an alarm and may cause suppression of the control depending upon whether the process variable is critical, as for example oxygen level; whereas, the less critical process variables will signal an alarm to the operator, however, the control will carry on.

Operator input device 27 effectively inputs a target value to the controller via a manually operable switch 43. Operation of switch 43 increments or decrements a digital number visually displayed on a visual display 45 of the input device. As the operator moves switch 43 to an upward mode or to a downward mode, the display value in display 45 increments or decrements according to the mode to which switch 43 is moved. When the display reaches a digital number desired by the operator, the operator discontinues actuation of switch 43. Through input device 27, the controller reads in the input information and outputs back to the device 27 to display in a digital form at the display 45.

An Enter Target button 47 located on input device 27 is manually actuable by the operator for effectively entering the value displayed on display 45 into controller 21. When the Enter Target switch is activated, the controller 21 will then formally enter the target value in the memory at 33.

Figure 2:
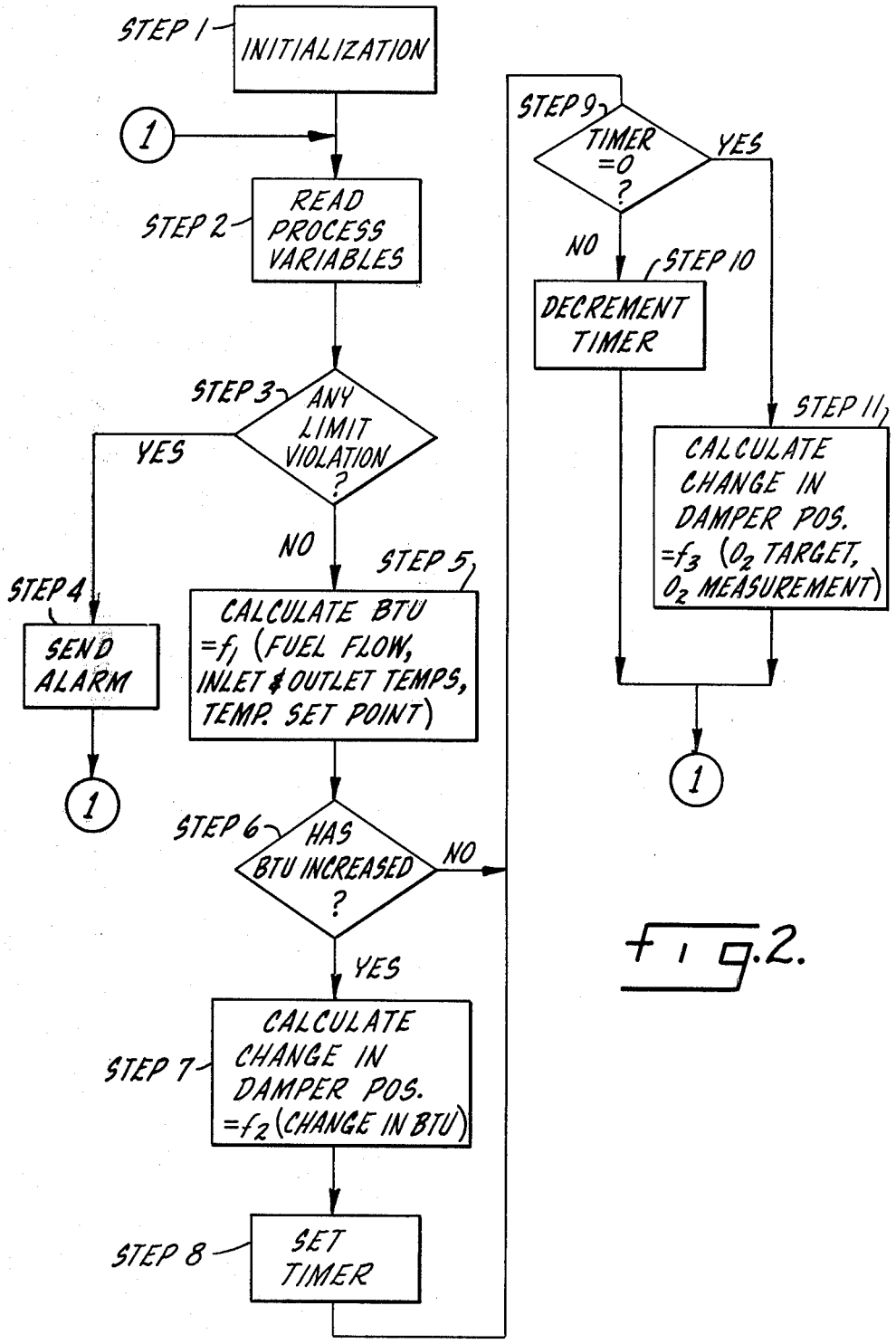
FIG. 2 is a flow diagram of the preferred operation of the controller of FIG. 1.

In order to obtain the data required for control of the stack damper, the controller steps through a control sequence broadly illustrated in the flow chart of FIG. 2. Step 1 indicates the initial entry point into the sequence in which the system is first initialized. After initialization, the process variables appearing on leads 30 are read (STEP 2) and determination is made as to whether any of the variables violate its appropriate limit range, STEP 3. If a limit range is violated, an alarm is sounded, STEP 4, and return is made to continue reading process variable at STEP 2.

Where none of the system variables violate its respective limit range, the BTU necessary for the combustion process is calculated as a function of the oil flow, the heater inlet temperature, the heater outlet temperature, and the temperature set point of the outlet temperature controller, at STEP 5. The temperature set point is the point on the outlet temperature controller (not shown) at which the operator sets the controller for requesting a selected temperature. The monitoring of the temperature set point is an important feature which permits the controller to promptly anticipate an increase demand for combustion.

The calculation of BTU is according to the following formula:

$$BTU=A\cdot(\text{oil flow})\cdot(\text{outlet temperature}-\text{inlet temperature}),$$

where A is a constant and the outlet temperature used is either the actual outlet temperature or the temperature of the temperature set point, depending on which of the two is higher.

A determination at STEP 6 is made as to whether the BTU has increased to such an extent that a change in damper position is required. The former value of BTU is compared with the new value of BTU for generating a change in BTU. The change in BTU is compared with a threshold dead-band value for determining whether the change in BTU is sufficient to request a damper change.

Where a change is required, a change of the damper position is calculated in terms of the change in BTU, STEP 7. A mathematical formula is utilized wherein the change in BTU is the value of a variable in the mathematical formula for generating a value representative of the number of pulses to be fed on output lead 23 (FIG. 1) for commanding set point station 17 to open the damper. The mathematical formula for calculating the change of damper position is a proportional formula:

$$\text{Change Of Damper Position}=K\cdot\text{Change in BTU},$$
where K=proportional constant.

Steps 5 through 7 form the feed forward control 39 in which the damper position is changed in accordance with an anticipated need for oxygen in the stack.

Once a change in damper position has been calculated in view of anticipated oxygen need, the controller inhibits the calculation of a change in damper position resulting from the deviation between the oxygen reading and the oxygen target entered by the operator. A timer is set at STEP 8 for delaying the oxygen target control function of the controller to permit the anticipated combustion process to catch up with the increased oxygen level supplied in the stack. The timing function is performed by the controller passing through STEPS 9, 10 to decrement the timer.

After the timer has completed its timing via STEPS 9 and 10, the controller calculates the change in damper position required by the oxygen target value at STEP 11. The damper position is calculated as a function of both the monitored excess oxygen level and the excess oxygen target value, according to the formula:

$$\text{ERROR}=(\text{oxygen target})-(\text{monitored oxygen level})$$

The value of ERROR generated is fed to a proportional integral algorithm for generating a value representative of the number of pulses to be outputted over leads 23 or 25 for opening or closing the damper.

This conventional proportional integral algorithm is as follows:

$$\Delta M_N = K_c\left[(\text{ERROR}_N - \text{ERROR}_{N-1}) + \frac{T}{T_i}\cdot\text{ERROR}_N\right]$$

where $\Delta M_N = M_N - M_{N-1}$ (*change of damper position*)

$M_N$=current damper position $M_{N-1}$=previous damper position $K_c$=proportional constant T=a constant representing how often the feedback control (step 11) is entered, e.g. 2 seconds, during normal feed back control $T_i$—a constant which serves as a tuning factor which determines how fast it is desired to reach the target value.

AS the controller continues to enter STEP 11 in the successive sequencing through the function program of FIG. 2, the stack oxygen begins to approach the target value and the change in damper position approaches zero change. STEP 11 is represented by feedback control 37 controlling the damper position.

Controller 21 also monitors the status of a manual/-computer switch 71 on the set point station 17. With switch 71 in the computer mode, the controller performs its automatic function of controlling the damper position; with switch 71 in the manual mode, the controller discontinues controlling the damper along leads 23, 25 and the set point station may be manually operated by the operator for manually controlling the damper position. A pair of annunciators 73, 75 are located on operator input device 27 and are actuated by controller 21 for displaying whether the controller is OFF or ON, respectively.

Controller 21 also continually monitors the operator input device 27 for determining whether the excess oxygen target value has been changed by the operator. Preferably the operator input device is accessed responsive to the controller being interrupted by the operator pushing Enter Target button 47.

Where excess oxygen target changes are requested by the operator, the new value is checked against a preset safety limit stored in memory. If it is below this limit, the value is rejected and the old value continues to be used. An appropriate indication is provided to warn the operator through the target display 45 momentarily.

Controller 21 provides contact closures for producing alarm outputs to the operator. The alarm outputs may be visual and/or audible, and may be associated with particular alarm conditions as described above. Since the most severe violations are breaching the low limit of oxygen and/or the high limit of fire box pressure, the system may respond to either of these violations by continuously opening the damper until the violated limit is no longer breached. Similar actions other than alarms may also be included for severe violations, as for example, returning control to manual mode.

Controller 21 further produces a digital output to operator input device 27 for indicating the actual measurement of excess stack oxygen. A digital display 77 receives the digital output from controller 21 and responsively displays a digital number.

It should be understood, of course, that the foregoing disclosure relates to a preferred embodiment of the invention and that other modifications or alterations may be made therein without departing from the spirit or scope of the invention as set forth in the appended claims.

What is claimed is:

1. Apparatus for controlling a stack damper for maintaining stack oxygen content at an optimal level for minimizing fuel consumption of an associated heater in view of process conditions, comprising:

monitoring means for providing condition signals representative of a plurality of combustion process variables, said monitoring means measuring the excess stack oxygen level and generating an excess stack oxygen signal;

operator input means manually operable for permitting the operator to generate target data representative of an excess stack oxygen target value;

damper control means responsive to a damper control signal for positioning the damper according to said control signal; and control means including:

(1) feedforward control responsive to said condition signals for generating a damper control signal for positioning the damper at a position for substantially providing an oxygen level anticipated for combustion;

(2) feedback control responsive to said target data and said excess stack oxygen signal for generating a said damper control signal for positioning the damper at a position for substantially providing an oxygen level dictated by said target value; and (3) timing control responsive to said feedforward control demand for increasing combustion for inhibiting operation of said feedback control for a period of time.

2. Apparatus according to claim 1 wherein said control means includes damper positioning means for generating said damper control signal, said damper control signal formed of a plurality of pulses with each pulse representative of an incremental damper movement.

3. Apparatus according to claim 2 wherein said damper positioning means includes a pair of outputs for transmitting said pulses to said damper control means, one of said outputs for transmitting said pulses to open said damper and other of said outputs for transmitting said pulses to close said damper.

4. Apparatus according to claim 1 wherein said operator input means includes first visual display means for displaying said target value; and second visual display means for displaying said excess stack oxygen level; and wherein said control means is responsive to said excess stack oxygen signal for controlling said second visual display means.

5. Apparatus according to claim 4 wherein said operator input means includes manually actuable switch means for conjointly changing said target value on said first visual display means and changing said target data.

6. Apparatus according to claim 5 wherein said operator input means includes manually actuable enter means for interrupting said control means for affecting transmittal of said target data to said control means.

7. Apparatus according to claim 1 wherein said feedback control is responsive to the difference between said excess stack oxygen level and said target value for generating said damper control signal, said damper control signal having a characteristic dependent on said difference.

8. Apparatus according to claim 7 wherein said control signal is a pulse train, and said characteristic is the number of pulses in said train.

9. Apparatus according to claim 1 wherein the associated heater includes a heater temperature controller; and wherein said monitoring means measures fuel flow, heater inlet temperature, heater outlet temperature, and the set point temperature of the heater temperature controller and generates respective signals; and wherein said feedforward control is responsive to the signals of said fuel flow, said heater inlet temperature, said heater outlet temperature and said set point temperature for generating said damper control signal.

10. Apparatus according to claim 1 wherein said period of time is predetermined.

11. Apparatus according to claim 1 wherein said control means includes a limit control for opening the damper responsive to a low limit of stack oxygen being breached or a high limit of fire box pressure being breached.

* * * * *